US007396096B2

(12) United States Patent
Kobayashi et al.

(10) Patent No.: US 7,396,096 B2
(45) Date of Patent: Jul. 8, 2008

(54) INKJET RECORDING DEVICE

(75) Inventors: Shinya Kobayashi, Hitachinaka (JP); Hitoshi Kida, Hitachinaka (JP); Takahiro Yamada, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 337 days.

(21) Appl. No.: 11/190,015

(22) Filed: Jul. 27, 2005

(65) Prior Publication Data

US 2006/0023010 A1 Feb. 2, 2006

(30) Foreign Application Priority Data

Jul. 28, 2004 (JP) ..... P2004-219771

(51) Int. Cl.
*B41J 29/38* (2006.01)

(52) U.S. Cl. ..... 347/11; 347/9; 347/10; 347/14

(58) Field of Classification Search ..... 347/11, 347/9, 10

See application file for complete search history.

(56) References Cited

U.S. PATENT DOCUMENTS 5,936,644 A * 8/1999 Ono et al. ..... 347/10
5,992,978 A * 11/1999 Fujii et al. ..... 347/54
6,217,141 B1 * 4/2001 Nakamura et al. ..... 347/10
6,547,368 B2 * 4/2003 Silverbrook ..... 347/32
2003/0142160 A1 * 7/2003 Kobayashi et al. ..... 347/14

FOREIGN PATENT DOCUMENTS

| | | |
|---|---|---|
| JP | 4-316851 | 11/1992 |
| JP | 9-11457 | 1/1997 |
| JP | 2002-273890 | 9/2002 |

* cited by examiner

*Primary Examiner*—Julian D. Huffman
*Assistant Examiner*—Jason S Uhlenhake
(74) *Attorney, Agent, or Firm*—Whitham Curtis Christofferson & Cook, PC

(57) ABSTRACT

An inkjet recording device includes a nozzle module, a switching unit, a waveform generating unit, an image recognizing unit and a pulse width modulating unit. The image recognizing unit determines an ejection condition of the ink droplet ejected from the nozzle while referring to ejection data indicating a type of each pixel to be recorded, and generates switch pulse width data that includes the ejection data and the ejection condition. The pulse width modulating unit generates the switch pulse based on the switch pulse width data. The switching unit opens and closes in response to a switch pulse. An opening duration of the switch unit is variable depending on the switch pulse.

10 Claims, 14 Drawing Sheets

| NOZZLE ADDRESS | SWITCH PULSE WIDTH TABLE | | |
|---|---|---|---|
| | (a) D11=D12=D13=1 D21=D22=D23=1 D31=D32=D33=1 | (b) D22=1, AND AT LEAST ONE OF D11-D21 AND D23-D33=0 | (c) D22=0 |
| 0 | Tp1-w | Tp1-v | 0 |
| 1 | Tp2-w | Tp2-v | 0 |
| 2 | Tp3-w | Tp3-v | 0 |
| 3 | Tp4-w | Tp4-v | 0 |
| 4 | Tp5-w | Tp5-v | 0 |
| ⋮ | | | |
| 255 | Tp256-w | Tp256-v | 0 |

INKJET RECORDING DEVICE

BACKGROUND OF THE INVENTION

1. Field of the Invention

The present invention relates to an on-demand type inkjet recording device, and particularly to a high-speed inkjet recording device that records images using a plurality of nozzles.

2. Description of Related Art

An inkjet recording device provided with a recording head having a plurality of nozzles can record images at a high rate of speed and at a high density on recording medium due to the plurality of nozzles.

Such inkjet recording devices are categorized as continuous type or on-demand type devices. The on-demand type inkjet recording device, such as that disclosed in Japanese unexamined patent application publication No. 2002-273890, has a simpler construction than that of the continuous system. Therefore it is possible to dispose hundreds or thousands of nozzles to be disposed at a high density in the on-demand type inkjet recording device.

However, in such a multi-nozzle inkjet recording device, the ejection velocity and weight of ink droplets ejected from multiple nozzles tend to vary widely among nozzles. When the ejection velocity varies, the position at which ink droplets land on the recording medium also varies, leading to an obvious deterioration in image quality in lines of text, figures, tables, and the like. When the weight of the ink droplets varies, on the other hand, the surface area of the dots on the recording medium also varies, producing irregular densities in the image, particularly halftone images.

Therefore, multi-nozzle inkjet recording devices have been proposed for regulating the ejection velocity or ink droplet weight for each nozzle by making separate fine adjustments to the drive voltage waveform applied to the piezoelectric element or heating element of each nozzle.

For example, Japanese unexamined patent application publication No. HEI-9-11457 provides a multi-nozzle inkjet recording device having a plurality of drive waveform generators for generating desired drive voltage waveforms. In this multi-nozzle inkjet recording device, appropriate drive voltage waveforms are selected for each nozzle to achieve a desired ink droplet weight or ejection velocity, and the selected drive voltage waveform is applied to the nozzle from the corresponding drive waveform generator.

Further, Japanese unexamined patent application publication No. HEI-4-316851 provides a multi-nozzle inkjet recording device having a single drive waveform generator capable of generating a plurality of drive voltage waveforms. In this multi-nozzle inkjet recording device, since the same drive voltage waveform is applied to all nozzles simultaneously, it is not possible to eject ink simultaneously from all nozzles while applying individual drive voltage waveforms to each nozzle. Therefore, a time-division method is used to apply an appropriate drive voltage waveform sequentially to one nozzle at a time, obtaining the desired ink droplet weight or ejection velocity.

However, in the conventional multi-nozzle inkjet recording device described above, including a combination of Japanese unexamined patent application publication No. HEI-9-11457 and No. HEI-4-316851, it is not possible to perform calibration for both ejection velocity and ink droplet weight simultaneously Variations in the weight can increase when variations in velocity are suppressed, while variations in the velocity can increase when variations in weight are suppressed.

SUMMARY OF THE INVENTION

In view of the above-described drawbacks, it is an objective of the present invention to provide a multi-nozzle inkjet recording device capable of recording high-quality images by selectively emphasizing either precision in droplet ejection velocity or precision in ink droplet weight.

In order to attain the above and other objects, the present invention provides an inkjet recording device. The inkjet recording device includes a nozzle module, a switching unit, a waveform generating unit, an image recognizing unit and a pulse width modulating unit.

The nozzle module has a plurality of nozzles for ejecting ink droplets and a plurality of piezoelectric elements. Each piezoelectric element includes a common electrode and an individual electrode. The piezoelectric element is deformed when a potential difference is generated between the common electrode and the individual electrode. The nozzles are provided in one-to-one correspondence with the piezoelectric elements. Each nozzle ejects the ink droplet in accordance with deformation of the corresponding piezoelectric element.

The switching unit includes one terminal connected to the individual electrode and another terminal grounded. The switching unit is capable of opening and closing in response to a switch pulse. The opening duration of the switch unit is variable depending on the switch pulse. The waveform generating unit applies a drive voltage to the common electrodes of all the nozzles commonly.

The image recognizing unit determines an ejection condition of the ink droplet ejected from the nozzle while referring to ejection data indicating a type of each pixel to be recorded, and generates switch pulse width data that includes the ejection data and the ejection condition. The pulse width modulating unit generates the switch pulse based on the switch pulse width data.

BRIEF DESCRIPTION OF THE DRAWINGS

The above and other objects, features and advantages of the invention will become more apparent from reading the following description of the preferred embodiments taken in connection with the accompanying drawings in which:

FIG. 11(*b*) is graphs showing another example of ink droplet velocity and weight characteristics in response to a nozzle ejection voltage;

FIG. 11(*c*) is graphs showing another example of ink droplet velocity and weight characteristics in response to a nozzle ejection voltage;

DETAILED DESCRIPTION OF THE PREFERRED EMBODIMENTS

An inkjet-recording device according to a first embodiment of the present invention will be described while referring to FIGS. 1 through 11.

Figure 1:
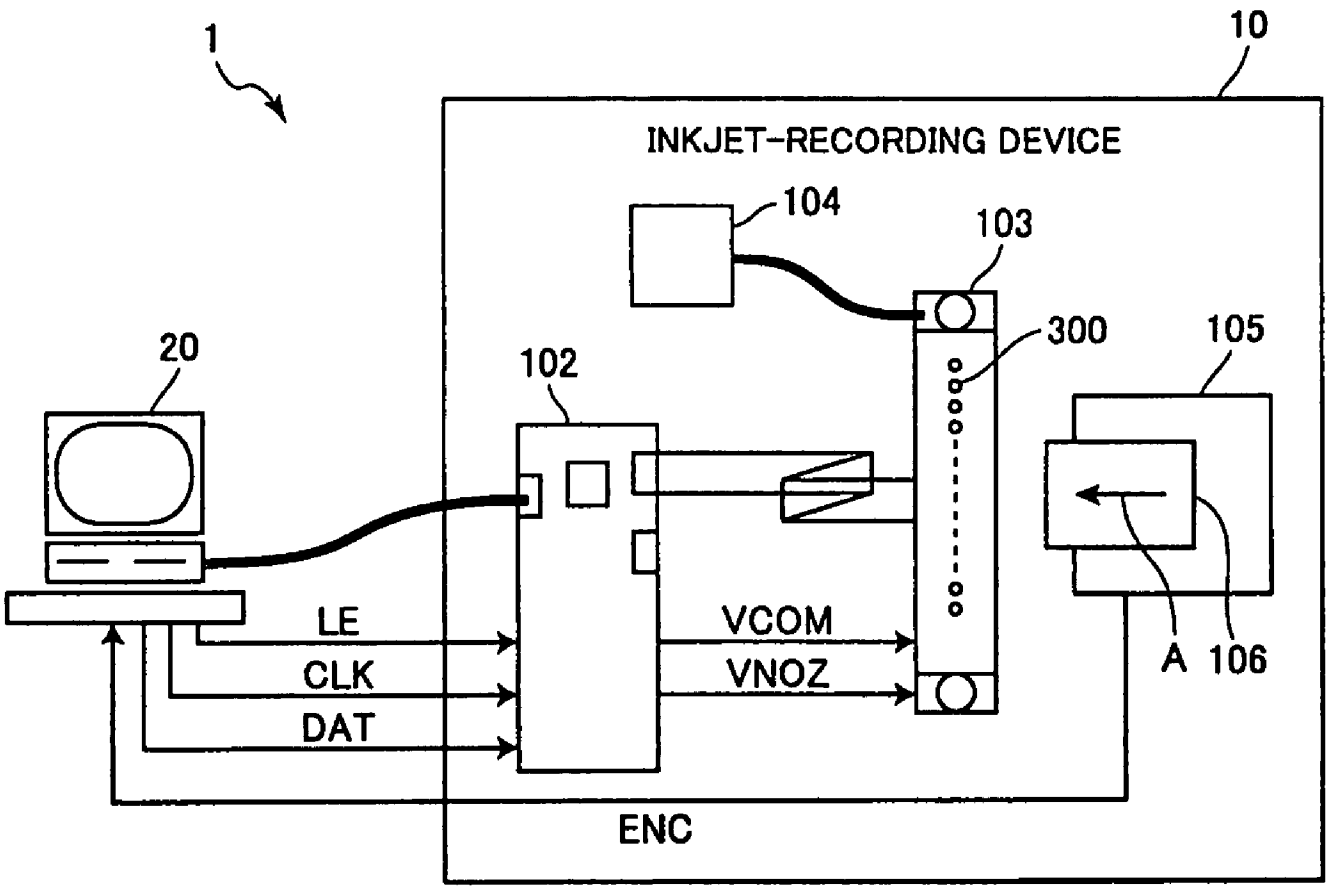
FIG. 1 is a schematic diagram showing an overall ink ejection system according to a first embodiment of the present invention.

FIG. 1 shows the overall structure of an ink ejection system 1 equipped with an inkjet-recording device 10 according to the first embodiment. The ink ejection system 1 has a general structure similar to a common inkjet-recording system. As shown in FIG. 1, the ink ejection system 1 includes the inkjet-recording device 10 and a controller 20 such as a personal computer.

The inkjet-recording device 10 includes an inkjet head module (hereinafter referred to as a "head module") 103, a paper conveying device 105, an inkjet head drive circuit (hereinafter abbreviated to "drive circuit") 102, and an ink tank 104. A plurality (256 in the preferred embodiment) of nozzles 300 is arranged in a row in the head module 103. The paper conveying device 105 conveys a recording paper 106 in a paper conveying direction A (indicated by the arrow A in the drawing) orthogonal to the row of nozzles 300 while outputting paper position detection signals ENC that indicate paper positions, to the controller 20. The drive circuit 102 actuates the head modules 103 while transmitting a common drive voltage VCOM for all nozzles 300 and individual drive voltages VNOZ for each nozzle 300 in order to form an image on the recording paper 106. The ink tank 104 supplies ink to the head modules 103 via a pipe.

The controller 20 outputs a latch enable signal LE, a data clock pulse CLK, and ejection data DAT to the drive circuit 102. The latch enable signal LE is transmitted in synchronization with the paper position detection signal ENC in order to instruct start of forming of each line that configures a part of an image and is parallel to the row of nozzles 300. The latch enable signal LE according to the preferred embodiment is a short pulse signal of 10 KHz.

The ejection data DAT is serial data with respect to ejection from each of the nozzles 300 arranged in order of $1^{th}$ to $256^{th}$ nozzle 300. The ejection data DAT is "1" or "0", where "1" represents ejection and "0" represents no ejection. The ejection data DAT is transmitted in synchronization with the data clock pulse CLK. The controller 20 begins transmitting the data clock pulse CLK and the ejection data DAT at the same instant of the transmitting of the latch enable signal LE. In the preferred embodiment, the data clock pulse CLK has a frequency of 5 MHz. Accordingly, 51.2 μs are required to transmit the 256 ejection data elements DAT for all of the nozzles 300.

When the latch enable signal LE is generated, 256 bits of ejection data DAT, that has one-to-one correspondence with 256 of the nozzles 300 for the first line (line 1) of an image being recorded, is transferred. After one line worth of data has been transferred, 256 bits of data for the next line is transferred when the latch enable signal LE is generated again. The ejection data DAT for subsequent lines are transferred in the same way.

Figure 2:
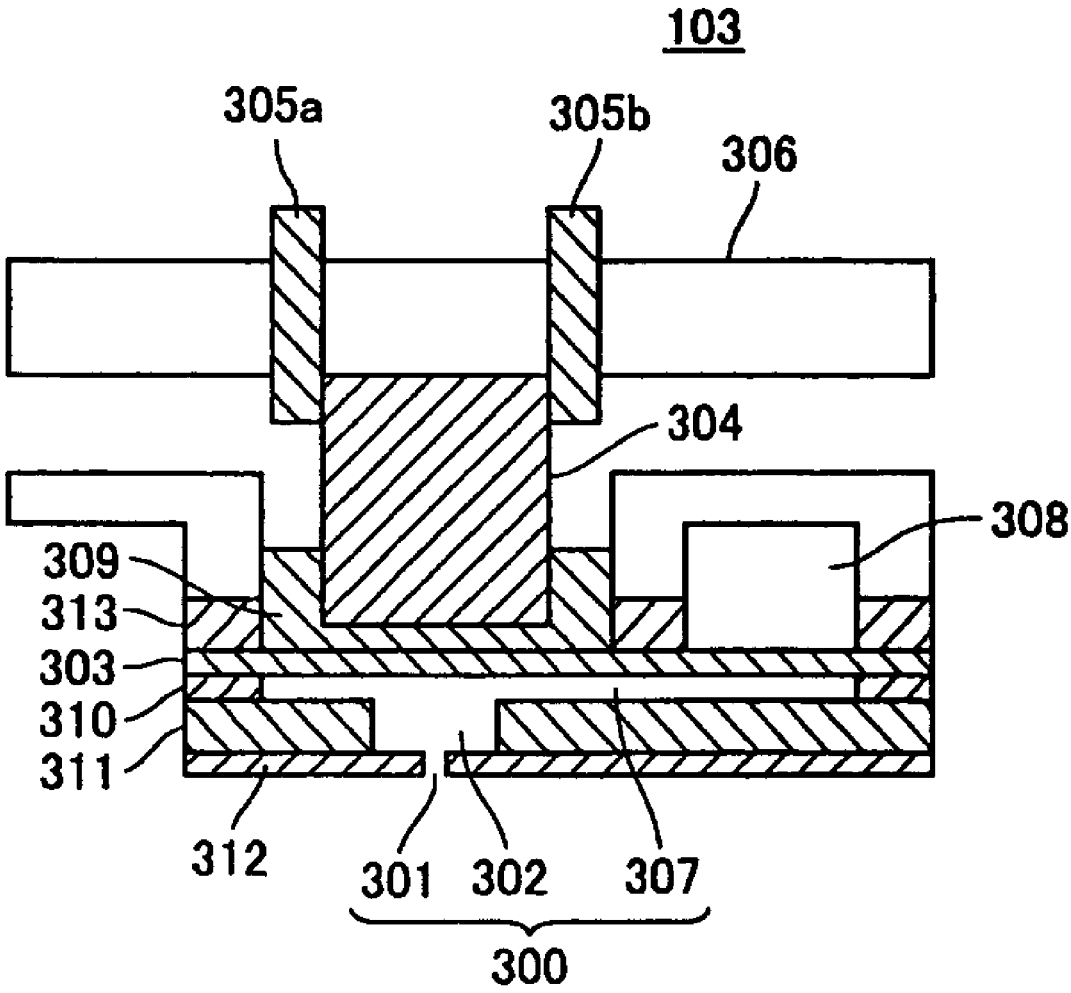
FIG. 2 is a cross-sectional view of an inkjet head module employed in the inkjet recording device according to a first embodiment.

The head module 103 will be described with reference to FIG. 2. FIG. 2 shows a part of the head module 103 corresponding to one nozzle 300. The part of the head module 103 includes the nozzle 300, an orifice plate 312, a pressure chamber plate 311, a restrictor plate 310, a vibration plate 303, a piezoelectric element fixing substrate 306 and a support plate 313. The nozzle 300 includes a nozzle hole 301 (orifice) formed by the orifice plate 312, a pressure chamber 302 formed by the pressure chamber plate 311, and a restrictor 307 formed by the restrictor plate 310. A common ink supply channel 308 for supplying ink to the pressure chamber 302 is formed in the nozzle module 103. The restrictor 307 is in communication with the common ink supply channel 308 and pressure chamber 302 to control the amount of ink flow to the pressure chamber 302.

Each nozzle 300 also includes a piezoelectric element 304. One part of the piezoelectric element 304 is fixed to the piezoelectric element fixing substrate 306 and another part of the piezoelectric element 304 is linked to the vibration plate 303 by an elastic material 309, such as a silicon adhesive. The piezoelectric element 304 includes a pair of signal input terminals 305*a* and 305*b*. The piezoelectric element 304 expands and contracts when a voltage difference is generated between the signal input terminals 305*a* and 305*b*, and remains in its original shape when a voltage is not applied. The support plate 313 reinforces the vibration plate 303.

For example, the vibration plate 303, restrictor plate 310, pressure chamber plate 311, and support plate 313 are made from stainless steel while the orifice plate 312 is constructed from a nickel material. The piezoelectric element fixing substrate 306 is formed of an insulating material, such as a ceramic or polyimide.

With this construction, ink supplied from the ink tank 104 (FIG. 1) flows downward to each of the restrictors 307 via the common ink supply path 308 and is supplied into the pressure chambers 302 and nozzle holes 301. When a voltage difference is generated between the signal input terminals 305*a* and 305*b*, the piezoelectric element 304 deforms and a portion of the ink in the pressure chamber 302 is ejected through the nozzle hole 301.

Figure 3:
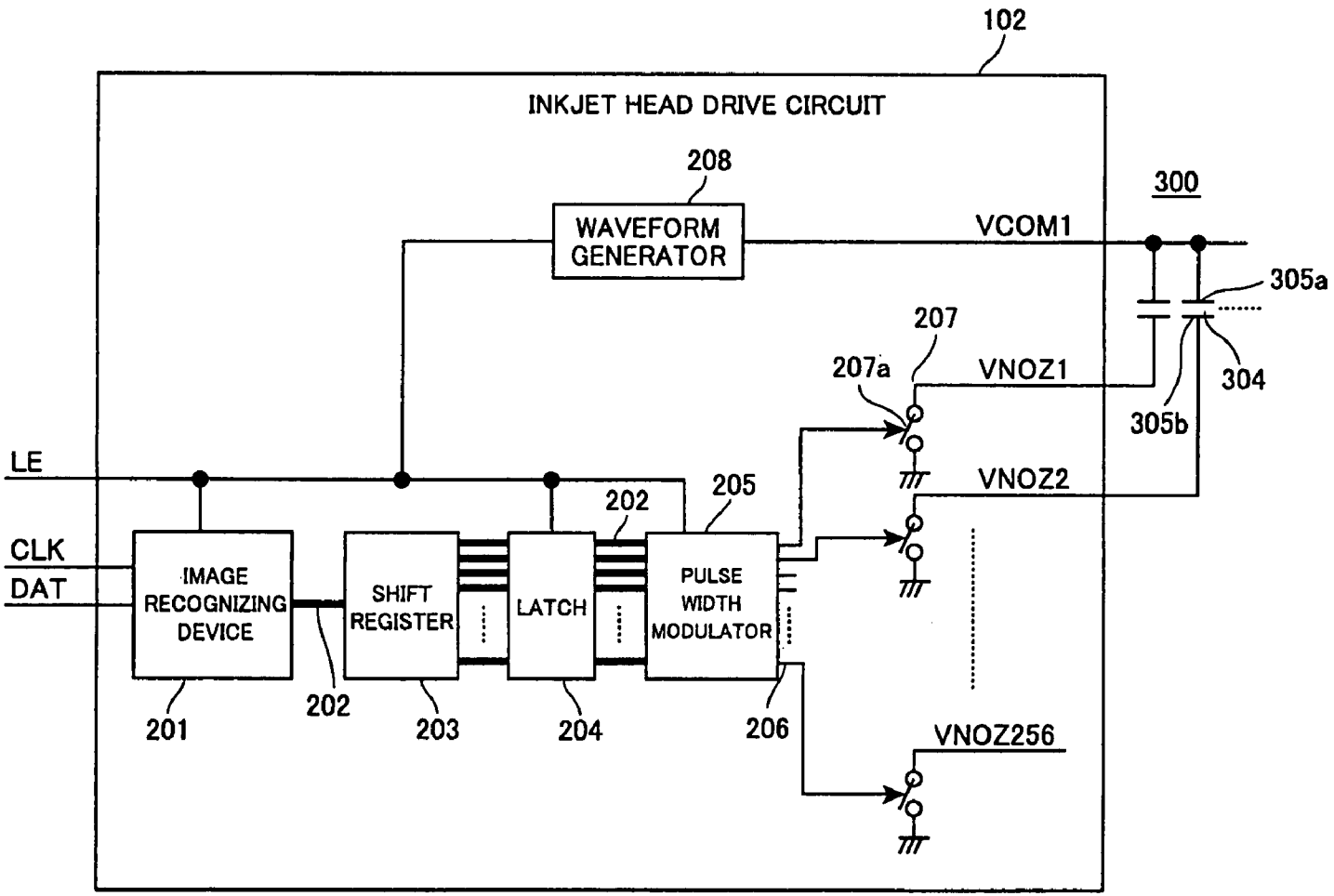
FIG. 3 is a block diagram showing an inkjet drive circuit according to a first embodiment.

Next, the drive circuit 102 will be described with reference to FIG. 3. The drive circuit 102 includes an image recognizing device 201, a shift register 203, a latch 204, a pulse width modulator 205, a waveform generator 208, and 256 switches 207. The switches 207 have a one-to-one correspondence with the piezoelectric elements 304 (nozzles 300).

The image recognizing device 201 converts 1 bit ejection data DAT for each nozzle to 8 bit switch pulse width data 202 for modifying each nozzle's variation. The switch pulse width data 202 are stored in the shift register 203 sequentially in synchronization with the data clock pulse CLK. When all of the switch pulse width data 202 for the 256 nozzles 300 have been accumulated in the shift register 203 and the latch enable signal LE is generated, the latch 204 latches all of the switch pulse width data 202 accumulated in the shift register 203 simultaneously in synchronization with the latch enable signal LE. Then, the switch pulse width data 202 latched by the latch 204 is input into the pulse width modulator 205. The pulse width modulator 205 converts the switch pulse width data 202 to a switch pulse 206, and the switch pulse width data 202 is outputted to the corresponding signal input 207*a* of the switch 207.

The upper side of each switch 207 is connected to the signal input terminal 305*b* of the corresponding nozzle 300, while the lower side is grounded. If a "1" is inputted into the signal input 207*a*, that is, if the switch pulse 206 is a "1", the switch 207 closes. If a "0" is inputted into the signal input 207*a*, that is, if the switch pulse 206 is a "0", the switch 207 is opened. Thus, the individual drive voltages VNOZ1-VNOZ256 are applied to the signal input terminals 305*b* of each nozzle 300. This will be described in greater detail below.

The waveform generator 208 generates a common drive voltage VCOM in synchronization with the latch enable signal LE. The common drive voltage VCOM is applied to the signal input terminals 305*a* of all the nozzles 300 commonly.

Figure 4:
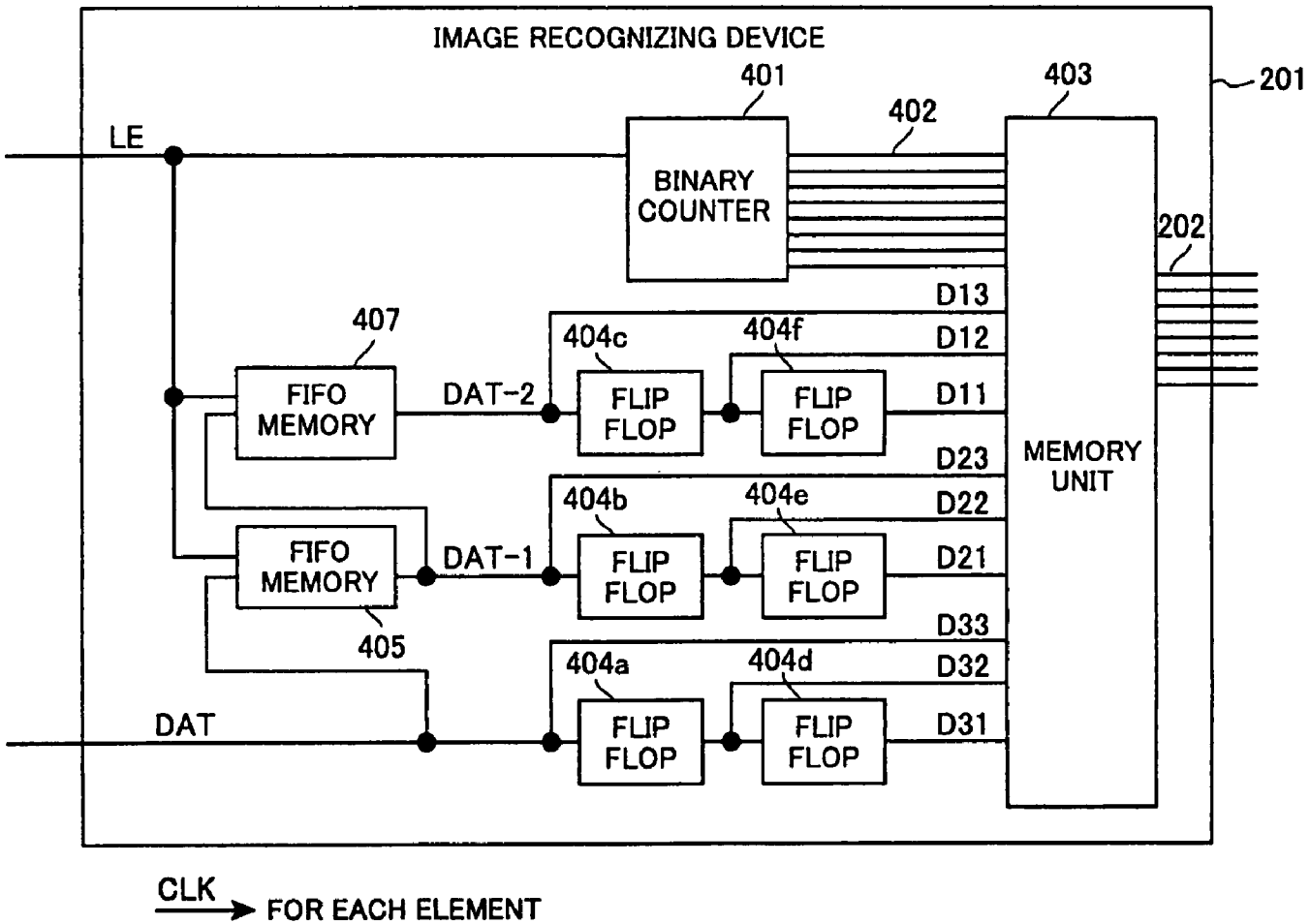
FIG. 4 is a block diagram showing an image recognizing device according to a first embodiment.

Next, the image recognizing device 201 will be described with reference to FIG. 4. The image recognizing device 201 includes a binary counter 401, a memory unit 403, FIFO memory units 405 and 407, and flip flops 404*a*-404*f*.

The binary counter 401 generates nozzle addresses 402 while counting the data clock pulse CLK. The first nozzle address 402 is "0" that indicates the first nozzle 300, and the last nozzle address 402 is "255" that indicates the $256^{th}$ nozzle 300. The binary counter 401 is cleared by the latch enable signal LE. The nozzle addresses 402 are outputted to the memory unit 403. Each nozzle address 402 corresponds to the ejection data DAT inputted into the memory unit 403 at same time.

The ejection data DAT inputted into the image recognizing device 201 is inputted into the memory unit 403 as the ejection data D33 in synchronization with the data clock pulse CLK. The ejection data DAT is also inputted into the flip flop 404*a* and the FIFO memory unit 405 in synchronization with the data clock pulse CLK.

The ejection data DAT inputted into the flip flop 404*a* is inputted to the memory unit 403 as the ejection data D32 in synchronization with the next data clock pulse CLK due to the storage function of the flip flop 404*a*. The ejection data DAT inputted into the flip flop 404*a* is also inputted to flip flop 404*d*. The ejection data DAT inputted into the flip flop 404*d* is also inputted to the memory unit 403 as the ejection data D31 in synchronization with the further next data clock pulse CLK.

The FIFO memory unit 405 can store 8 bit worth of the ejection data DAT and has an internal address counter that is reset to 0 by the latch enable signal LE. The FIFO memory 405 does not output the ejection data DAT inputted until 8 bit worth of the ejection data DAT corresponding to one line has been stored. When the ejection data DAT corresponding to one line has been stored in the FIFO memory unit 405, the FIFO memory unit 405 outputs ejection data DAT-1 in synchronization with the data clock pulse CLK in order stored. Since the FIFO memory unit 405 outputs data inputted before 8 bit, the ejection data DAT-1 corresponds to the previous line.

The ejection data DAT-1 is inputted to the memory unit 403 as the ejection data D23, D22 and D21 in the same manner of D33, D32 and D31. The ejection data DAT-1 is also inputted into the FIFO memory unit 407. The FIFO memory 407 outputs the ejection data DAT-2 to the memory unit 403 as D13, D12 and D11 in the same manner.

Figures 5, 6:
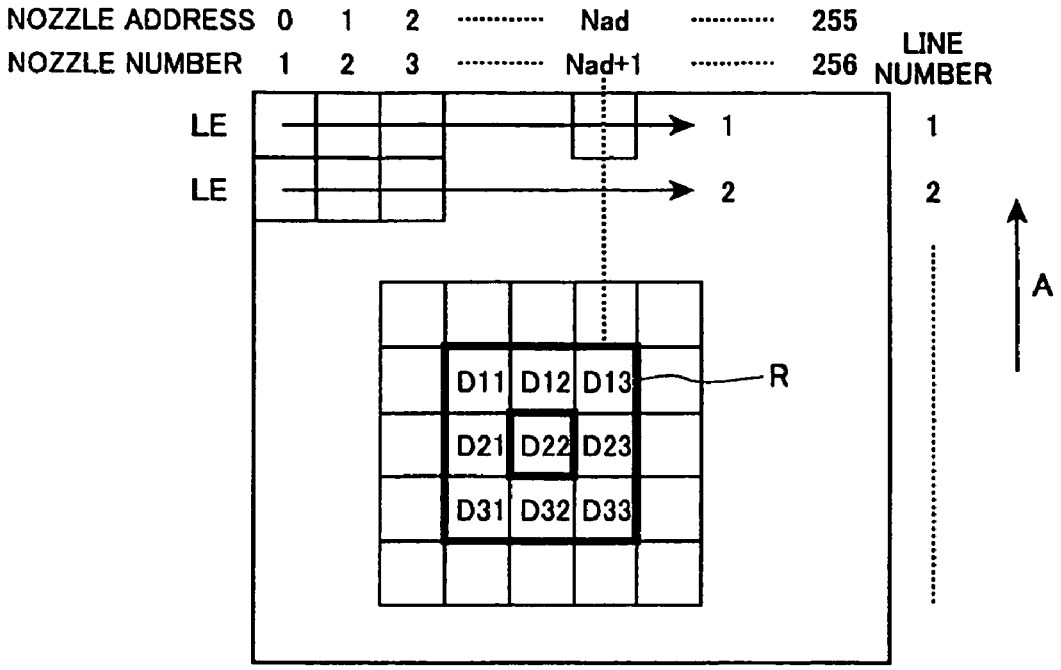
FIG. 5 is an explanatory diagram showing the order in which ejection data is transferred.
FIG. 6 is a schematic diagram showing switch pulse width data stored in a memory unit of the image recognizing device according to a first embodiment.

The ejection data D11-D33 obtained with this configuration indicates a region that is formed of a 3-by-3 (3×3) block of pixels in a recorded image as shown in FIG. 5. For example, D11 is the first nozzle in the first line, D12 is the second nozzle in the first line, D13 is third nozzle in the first line, D21 is first nozzle in the second line, D22 is the second nozzle in the second line, D23 is the third nozzle in the second line, D31 is the first nozzle in the third line, D32 is the second nozzle in the third line, and D33 is the third nozzle in the third line.

The ejection data D11-D33 are inputted all at once into the memory unit 403. The memory unit 403 generates switch pulse width data 202 for each nozzle 300 corresponding to the ejection data D22 that is a center of the region R. The memory unit 403 has stored switch pulse width table Tp for changing a flight condition, such as the quantity, of the ink droplet ejected from the nozzle 300 corresponding to the ejection data D22 in question. The switch pulse width table Tp has switch pulse width data 202 with respect to the ejection data D22 based on the condition of the ejection data D11-D33 for all the nozzles. The switch pulse width data Tp has been obtained from experiments.

The memory unit 403 judges the condition of the ejection data D22 based on the ejection data D11-D21 and D23-D33. Meanwhile, the memory unit 403 judges that the state of the ejection data D22 is which of (a) all of the ejection data D11-D33 are black dots ("1"), (b) the ejection data D22 is a black dot ("1") though at least one of the ejection data D11-D21 and D23-D33 is a white dot ("0"), or (c) the ejection data D22 is a white dot ("0") without reference to D11-D21 and D23-D33. Accordingly, it becomes that the memory unit 403 has stored switch pulse width table Tp that has the switch pulse width data 202 for each nozzle for each of (a), (b), (c) described above.

FIG. 6 shows the switch pulse width table Tp. In the preferred embodiment, the switch pulse width data 202 for each nozzle 300 is set to "Tp1-w" through "Tp256-w" in the case of (a). The switch pulse width data 202 for each nozzle 300 is set to "Tp1-v" through "tp256-v" in the case of (b). The switch pulse width data 202 for each nozzle 300 is set to "0" in the case of (c).

Figure 7:
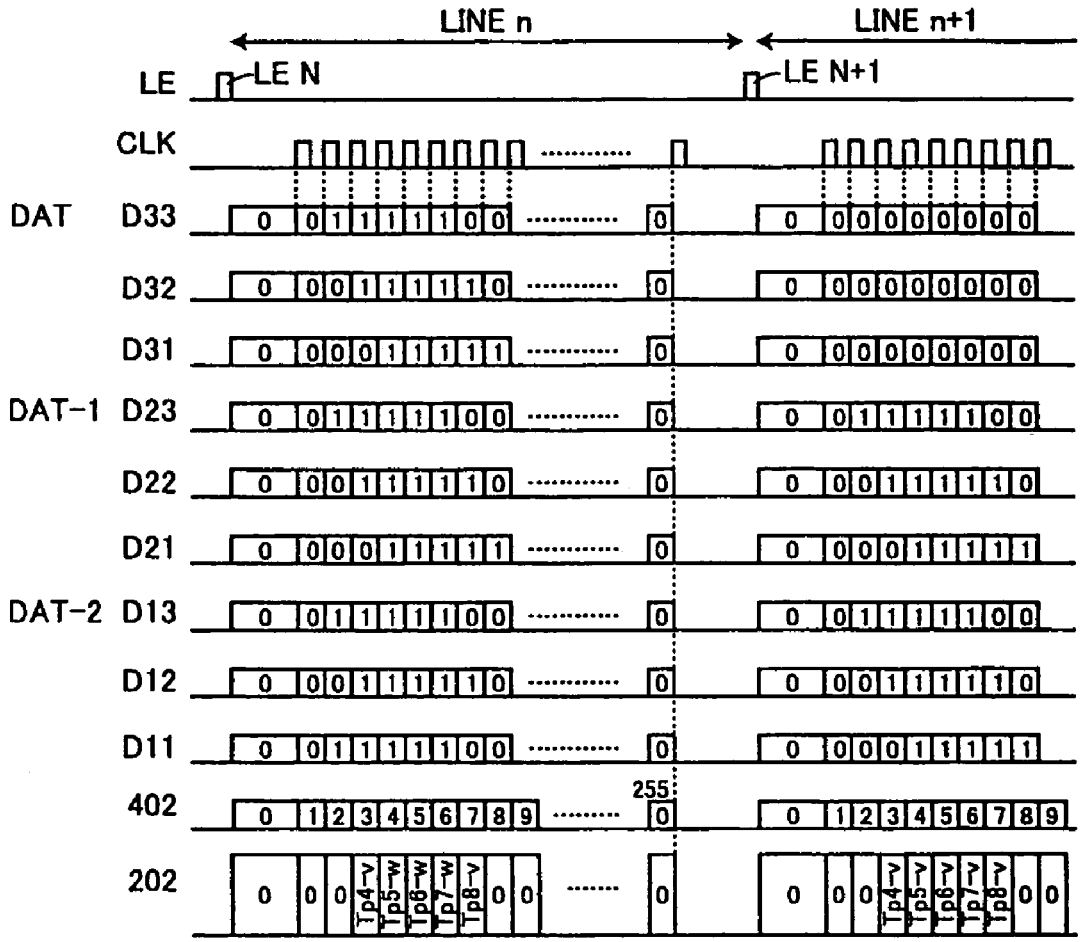
FIG. 7 is a explanation diagram showing a method of setting of the switch pulse width data.

FIG. 7 shows a method of setting of the switch pulse width data 202. In FIG. 7, the interval from LE N to LE N+1 is defined as line n, and the interval from LE N+1 to the LE N+2 (not shown) is defined as line (n+1). In FIG. 7, just the ejection data DAT for the first nozzle (nozzle address 402=0) through the ninth nozzle (nozzle address 402=8) in the line n are described for simplicity. In the present example, the ejection data DAT currently being transferred from the controller 20 is 001111100 . . . . Therefore, the ejection data D33 is also 001111100. The ejection data D32 is 000111110 . . . , since the ejection data D32 is one dot behind of the ejection data D33 due to the flip flop 404*a* (FIG. 4). The ejection data D31 is 000011111, since the ejection data is two dots behind of the ejection data D33.

The ejection data elements D23, D22, and D21 in the current transfer are identical with the ejection data DAT-1 transferred from the controller 20 one line earlier due to the FIFO memory 405 (FIG. 4), though the ejection data DAT-1 is the same as the ejection data DAT in the current transfer in the preferred embodiment. The ejection data elements D13, D12, and D11 are identical with the ejection data DAT-2 transferred two lines earlier due to the FIFO memory 405 and the FIFO memory 407, though the ejection data DAT-2 is the same as the ejection data DAT in the current transfer in the preferred embodiment. We will assume that all ejection data transferred three lines earlier or before are 0.

The first through third nozzles (nozzle addresses 402=0-2) of the switch pulse width data 202 are "0" referring to the switch pulse width table Tp in FIG. 6, since the ejection data D22 is "0. The fourth nozzle (nozzle address 402=3) is "Tp4-v" and the eighth nozzle (nozzle address 402=7) is "Tp8-v", since the ejection data D22 is "1" though at least one of the ejection data D11-D21 and D23-D33 is "0". The fifth through seventh nozzles (nozzle addresses 402=4-6) are "Tp5-w," "Tp6-w," and "Tp7-w". The ninth nozzle (nozzle address 402=8) and beyond are "0". Note that this switch pulse width data 202 actually controls ejection for the next line (n+1), since this switch pulse width data 202 is latched in synchronous with the next latch enable signal LE N+1.

Figure 8:
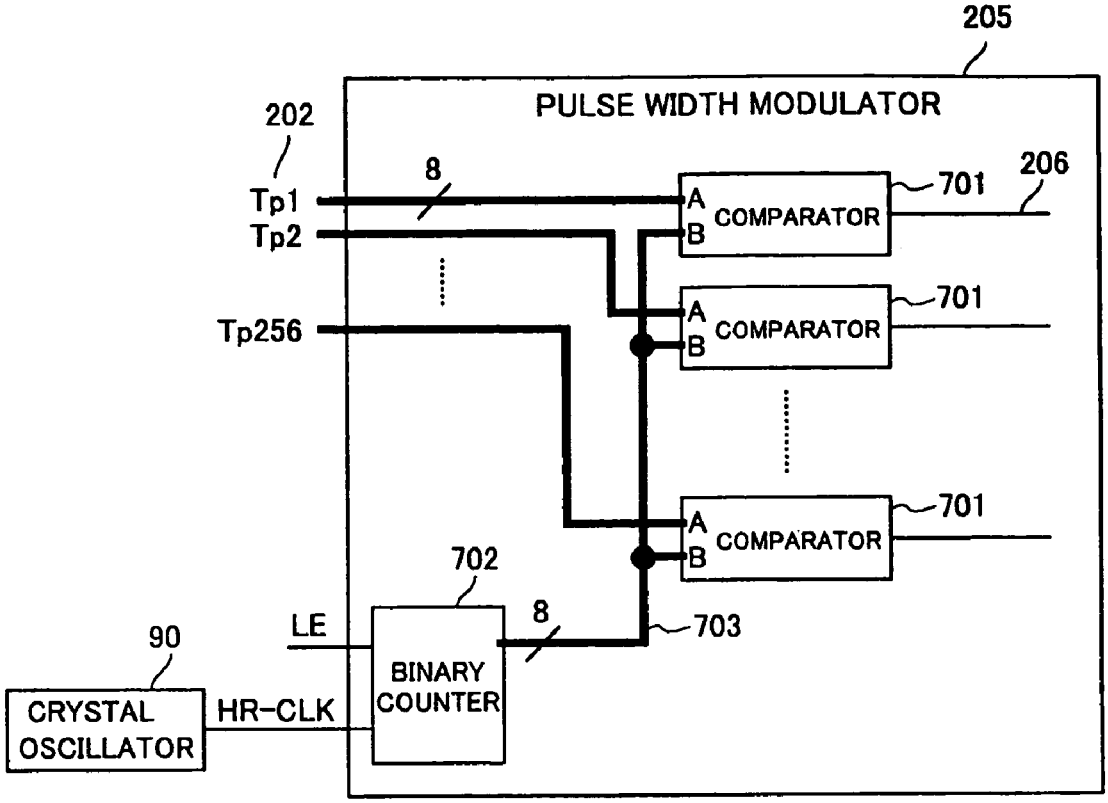
FIG. 8 is a block diagram showing a pulse width modulating device according to a first embodiment.

Next, the pulse width modulator 205 will be described with reference to FIG. 8. The pulse width modulator 205 includes 256 magnitude comparators 701 and a binary counter 702. The magnitude comparators 701 have a one-to-one correspondence with the nozzles 300. The switch pulse width data 202 outputted from the latch 204 (see FIG. 2) is inputted into an input A of the corresponding magnitude comparator 701. When the latch enable signal LE is inputted to the binary counter 702, the binary counter 702 begins to count a high-frequency clock pulse HR-CLK generated by a crystal oscillator 90 from 0 to 255, and simultaneously outputs a signal 703 to inputs B of all the magnitude comparators 701. The magnitude comparators 701 compare the magnitudes of the inputs A and B and generate a switch pulse 206. The switch pulse 206 is "1" when A>B while the switch pulse 206 is "0" when A≦B.

Figure 9:
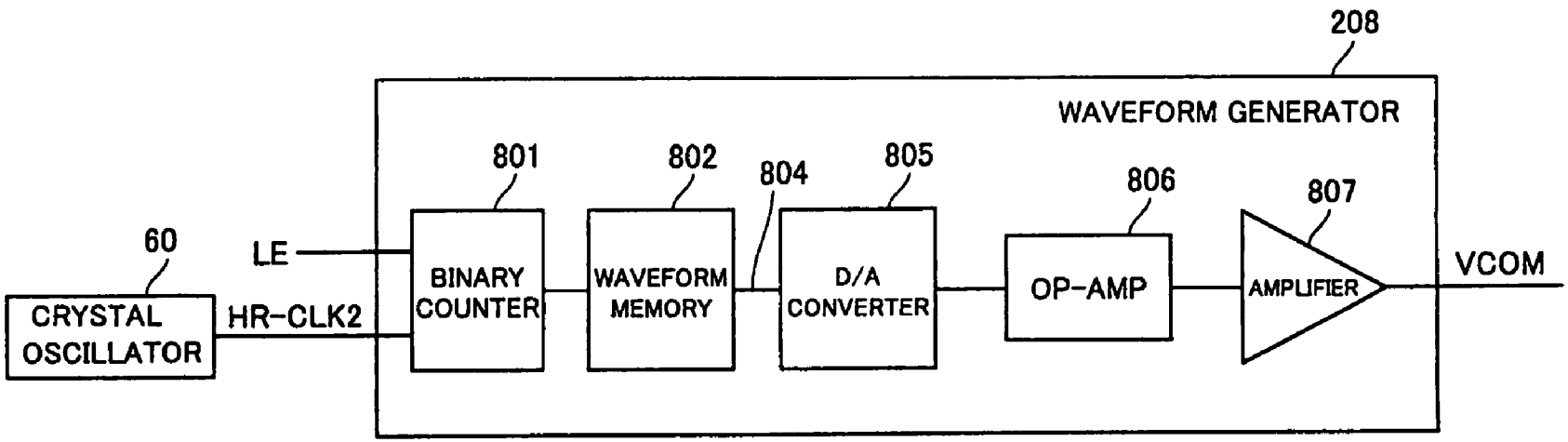
FIG. 9 is a block diagram showing a waveform generator according to a first embodiment.

Next, the configuration of the waveform generator 208 will be described with reference to FIG. 9. The waveform generator 208 includes a binary counter 801, a waveform memory unit 802, a digital/analog (D/A) converter 805 that is well known in the art, an op-amp circuit 806, and an amplifier 807. When the latch enable signal LE is inputted to the binary counter 801, the binary counter 801 begins to count a high-frequency clock pulse HF-CLK2 generated by a crystal oscillator 60, and simultaneously outputs the count to the waveform memory unit 802. The waveform memory unit 802 outputs output waveform data 804 previously stored therein to the D/A converter 805. The D/A converter 805 converts the output waveform data 804 to an analog signal. The analog signal is amplified by the op-amp circuit 806 and amplifier 807 and is applied to the signal input terminal 305*a* of each nozzle 300 as the common drive-voltage VCOM.

Figure 10:
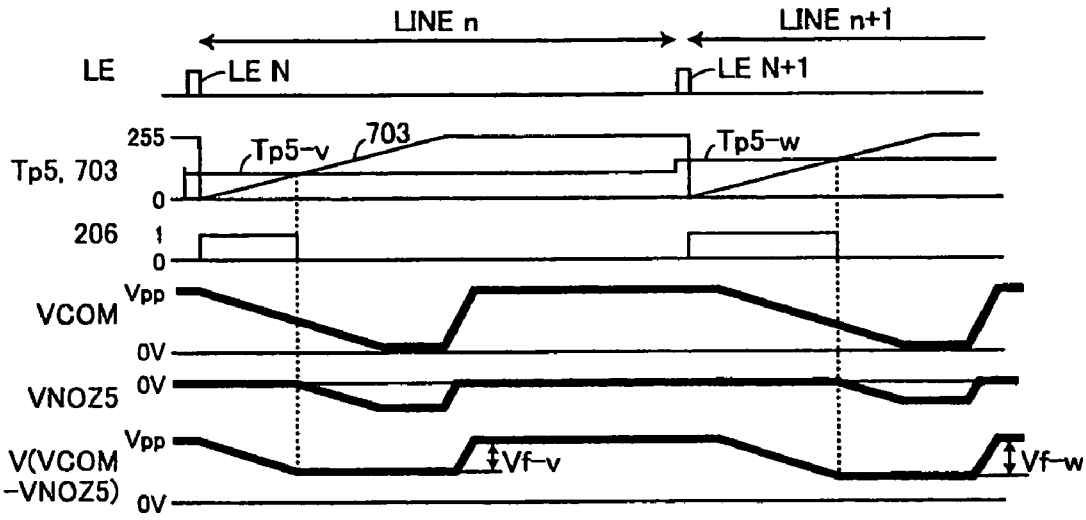
FIG. 10 is a timing chart showing the timing of operations performed in the inkjet drive circuit.

Next, operations of the pulse width modulator 205 will be described for the fifth nozzle 300 (nozzle address 402=4) referring to FIG. 10. FIG. 10 shows a timing chart for operations of the pulse width modulator 205. In FIG. 10, the interval from LE N to LE N+1 is defined as line n, and the interval from LE N+1 to LE N+2 (not shown) is defined as line (n+1). In the preferred embodiment, when the latch enable signal LN is inputted into the binary counter 702, the binary counter 702 begins to count from 0 to 255 and simultaneously outputs the signal 703 to the input B of the magnitude comparator 701. Tp5-v as the switch pulse width data 202 for line n is inputted into the input A of the magnitude comparator 701 in synchronization with the latch enable signal LE N, and Tp5-w is inputted for line (n+1) in synchronization with the latch enable signal LE N+1. Note that Tp5-v is not shown at the switch pulse width data 202 in FIG. 10 since the Tp5-v outputted in line n is generated at line n−1.

The magnitude comparator 701 is comparing the magnitudes of inputs A and B each time the binary comparator 702 is incremented. The magnitude comparator 701 outputs "1" to the signal input 207*a* as switch pulse 206 when the input A is larger than the input B, while outputting "0" to the signal input 207*a* as switch pulse 206 when the input A is smaller than the input B. The switch 207 closes when "1" is inputted into the signal input 207*a*, while the switch 207 is opened when "0" is inputted into the signal input 207*a*.

The waveform generator 208 also outputs the common drive voltage VCOM shown in FIG. 10 in synchronization with the latch enable LE N. The piezoelectric element 304 can be viewed as a capacitor. When the switch 207 closes (t1), the potential difference between the signal input terminal 305*a* and the signal input terminal 305*b* is the common drive voltage VCOM itself since the signal input terminal 305*b* is grounded. On the other hand, when the switch 207 is opened (t2), the potential difference between the signal input terminal 305*a* and the signal input terminal 305*b* since current cannot flow. As a result, the potential VNOZ5 is applied to the signal input terminal 305*b*. Consequently, the difference potential V (VCOM-VNOZ5) between the common drive voltage VCOM and the potential VNOZ5 is applied to the piezoelectric element 304. Hence, the pulse width modulator 205 outputs the switch pulse 206 to the signal input 207*a* of the corresponding switch 207. Meanwhile, a voltage V corresponding to the duration of the switch pulse 206 is applied to the piezoelectric element 304, since the switch 207 closes only when "1" is inputted to the signal input 207*a*.

The waveform of the drive voltage V is a trapezoidal wave well known in the art. When the voltage V drops, the pressure chamber 302 expands, drawing the meniscus inside the nozzle hole 301. When the voltage V rises (the voltage difference is called as an ejection voltage Vf), the pressure chamber 302 contracts, causing the meniscus to move outward. Thus, an ink droplet is ejected. The ejection velocity v and droplet weight w of the ink droplet ejected from the nozzle 300 varies according to the ejection voltage Vf.

Figure 11A:
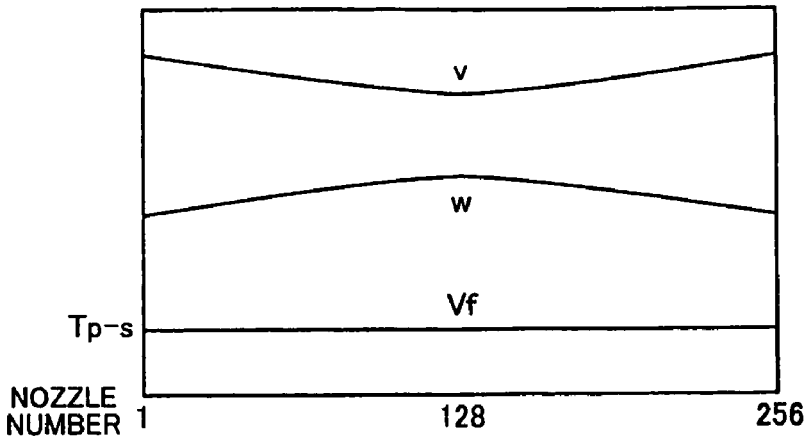
FIG. 11(*a*) is graphs showing an example of ink droplet velocity and weight characteristics in response to a nozzle ejection voltage.
Figure 11B:
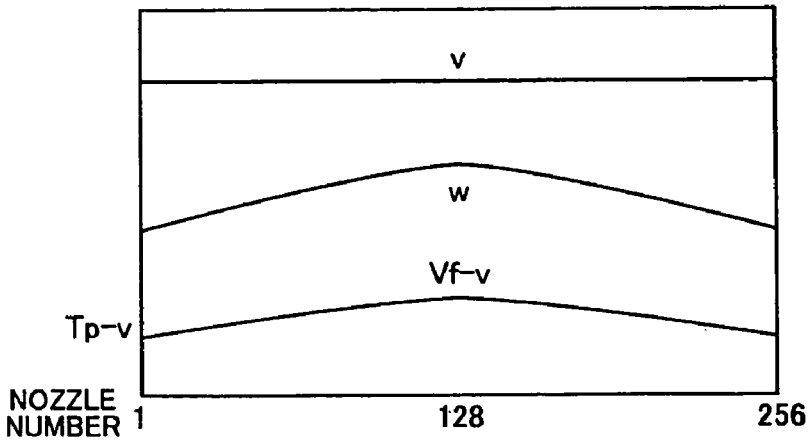
Figure 11C:
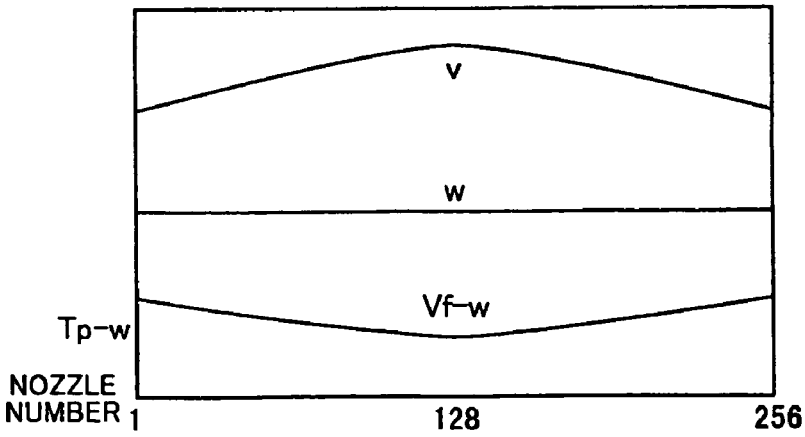

FIG. 11(*a*) shows the ejection velocity v and droplet weight w when the ejection voltage Vf for ejecting ink droplets is fixed at a constant value for all of the nozzles 300 ($1^{st}$ through $256^{th}$ nozzles). As can be seen from the graph, the ejection velocity v increases for nozzles 300 near both ends, while in contrast the droplet weight w decreases.

FIG. 11(*b*) shows the ejection velocity v and droplet weight w when the ejection voltage Vf has been adjusted to achieve a constant ejection velocity v for all ink droplets. The ejection voltage in this case is called the ejection voltage Vf-v. Since both the ejection velocity v and droplet weight w generally increase when increasing the ejection voltage Vf, the droplet weight w varies more among nozzles in this case than in the case of FIG. 11(*a*).

FIG. 11(*c*) shows the ejection velocity v and droplet weight w when the ejection voltage Vf has been adjusted to achieve a constant droplet weight w ejected from all the nozzles. The ejection voltage in this case is called the ejection voltage Vf-w. Since both the ejection velocity v and droplet weight w generally increase when increasing the ejection voltage Vf as described above, the ejection velocity v varies more among nozzles in this case than in the case of FIG. 11(*a*).

The "Tp1-v" through "Tp256-v" and the "Tp1-w" through "Tp256-w" stored in the memory unit 403 corresponds to the ejection voltage Vf-v and ejection voltage Vf-w for each nozzle.

In the preferred embodiment, it is possible to switch the priority for precision in droplet weight and precision in ejection velocity automatically for each pixel. Meanwhile, which of the precision in droplet weight or the precision in ejection velocity is determined based on the ejection data D11-D33 referring to the switch pulse width table Tp.

Since the ink droplet weight for each nozzle is fixed when printing a solid image (case (a)), it is possible to prevent streaks and other printing problems in the paper conveying direction A caused by irregularities in density. As a result, the quality of images can be improved. The quality of halftone images can similarly be improved by recording all dots in a halftone image at the same weight.

Since the ink droplet velocity for each nozzle is fixed when printing text or diagrams, such as graphs and tables (case (b)), it is possible to record high-quality images at a high rate of speed with no variation in the ejection positions.

Therefore, it is possible to achieve high quality printing of composite images.

Next, an ink ejection system according to a second embodiment of the present invention will be described with reference to FIGS. 12-14. Here, only a description of points different from the ink ejection system of the first embodiment will be given, while a description of common points will be omitted.

Figure 12:
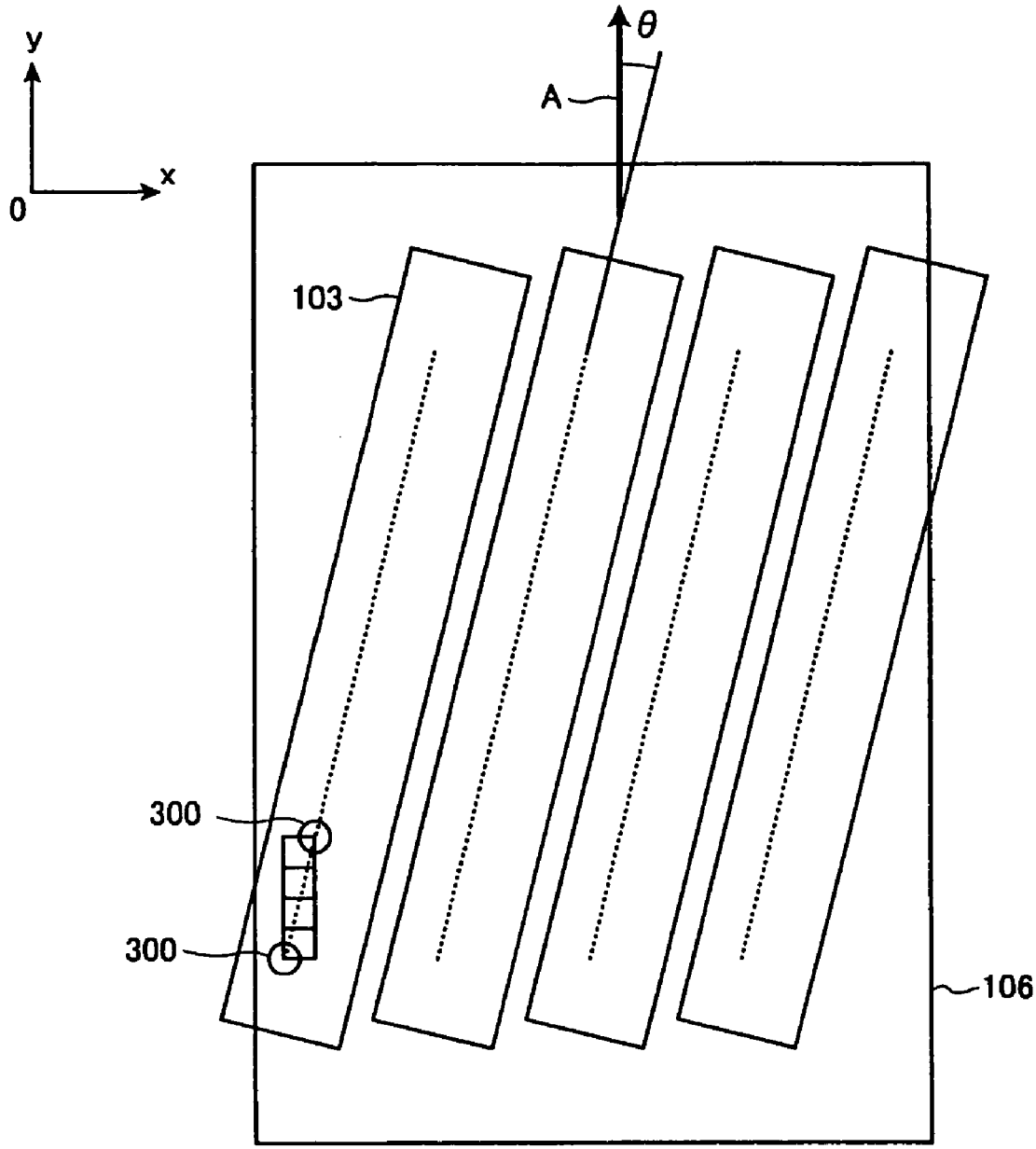
FIG. 12 is an explanatory diagram showing the arrangement of inkjet head modules according to a second embodiment of the present invention.

In the ink ejection system according to the second embodiment, as shown in FIG. 12, the head modules 103 are slanted in the clockwise direction from the paper conveying direction A, that is, the y-direction in FIG. 12 (the longitudinal dimension of the paper surface) by an angle θ (where tan θ=¼). This method of mounting the head modules 103 in a slanted orientation is a common technique to achieve high-density image recording when a pitch Pn between nozzles 300 in the nozzle rows is too large. If the recording pitch in the paper conveying direction A is Pp, then:

$$Pp = Pn \sin \theta$$

Although exaggerated in FIG. 12, the head modules 103 of the preferred embodiment are arranged so that the recording pitch in the x- and y-directions achieves a ratio of 1:4. While it is possible to secure a wide recording width by arranging a plurality of head modules 103 in the x-direction, in the following description it will be assumed that there is only one head module 103.

Figure 13:
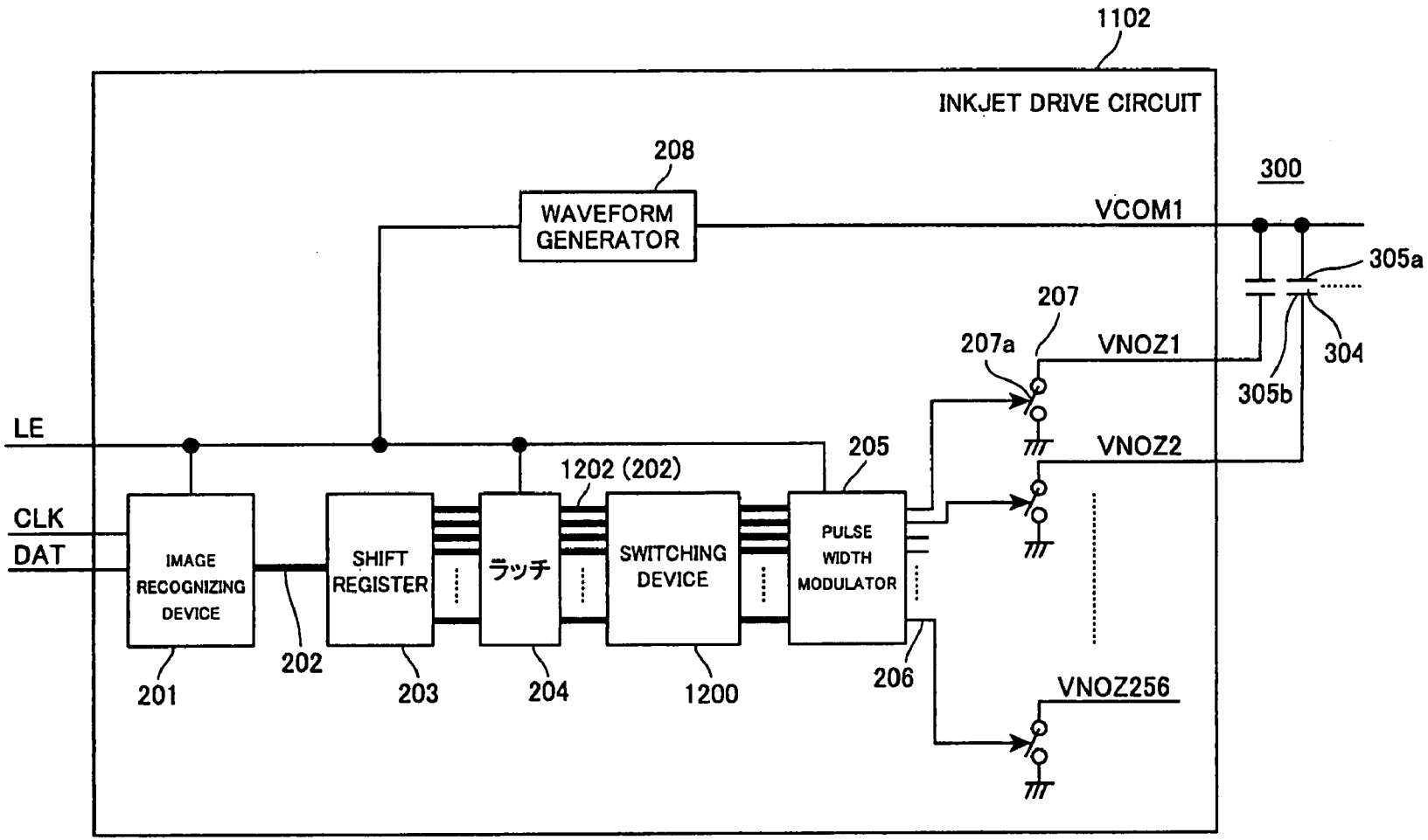
FIG. 13 is a block diagram showing an inkjet head drive circuit according to the second embodiment.

The ink ejection system according to the second embodiment includes a drive circuit 1102 in place of the drive circuit 102, as shown in FIG. 13. The drive circuit 1102 is configured almost identically to the drive circuit 102, but is also provided with a switch pulse width data switching device (hereinafter abbreviated to "switching device") 1200 disposed between the latch 204 and pulse width modulator 205.

If the switch pulse width data 1202 for all the nozzles 300 are inputted into the pulse width modular 205 simultaneously such as the first embodiment when the head modules 103 is slanted, a line is also formed slanted since the ejection data DAT is data with respect to the X-direction in FIG. 12. Therefore, the switching device 1200 adjusts the timing that each nozzle 300 ejects an ink droplet.

Figure 14:
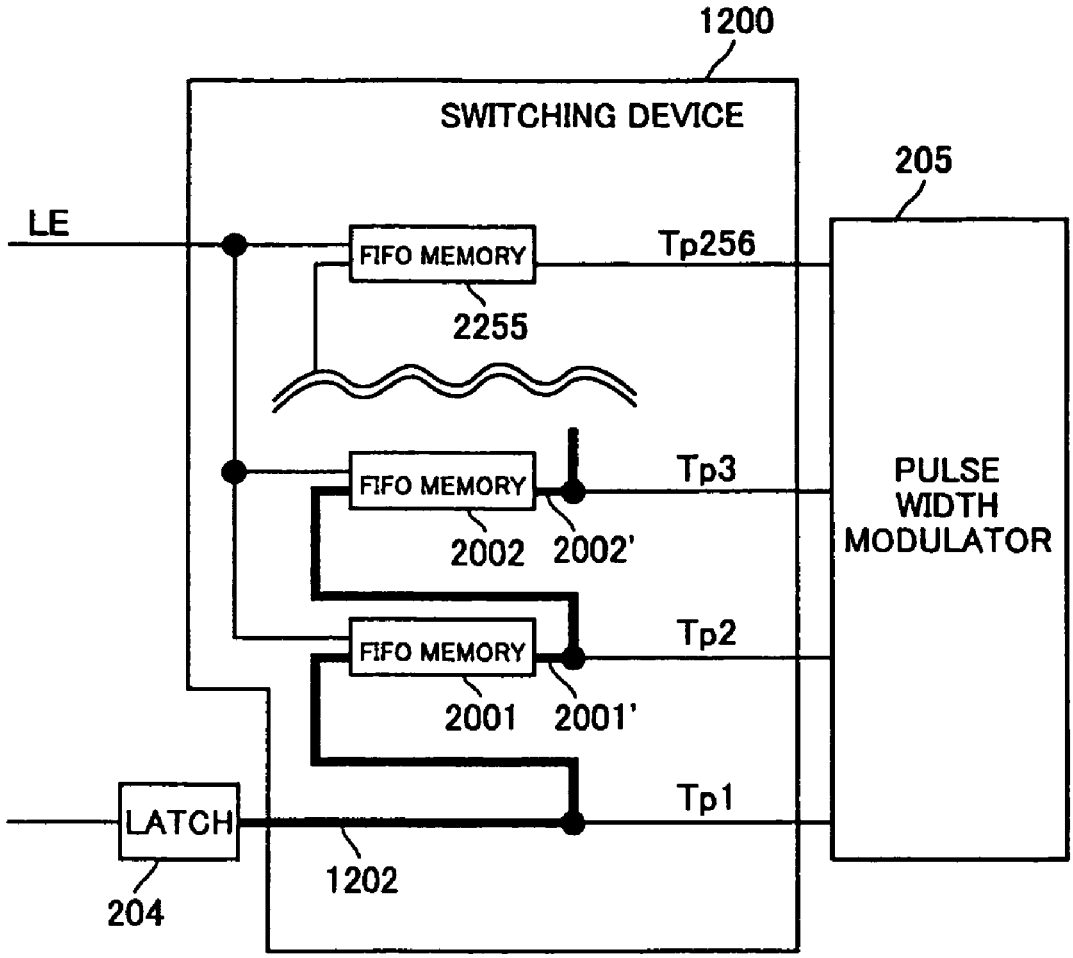
FIG. 14 is a block diagram showing a switch pulse width data rearranging device according to the second embodiment.

FIG. 14 shows a detailed configuration of the switching device 1200. The switching device 1200 includes 255 FIFO memory units 2001-2255, each having a capacity of four lines worth (four LEs worth) of data.

The latch 204 outputs a 256×8-bit latch output 1202 (switch pulse width data 202) for the $1^{st}$ through $256^{th}$ nozzles to the switching device 1200. Of this data, only 8 bits for the first nozzle (Tp1) is transferred to the pulse width modulator 205, while the remainder (255×8 bits) is inputted into the FIFO memory unit 2001. The FIFO memory unit 2001 outputs the remainder of the latch output 1202 for four lines earlier (255×8 bits) as output 2001'. Of this output data, only 8 bits for the $2^{nd}$ nozzle (Tp2) is transferred to the pulse width modulator 205.

The remainder of the output 2001' (254×8 bits) is inputted into the FIFO memory unit 2002. Hence, the FIFO memory unit 2002 outputs the remainder of the latch output 1202 for eight lines earlier as output 2002'. Of this output data, only 8 bits for the $3^{rd}$ nozzle (Tp3) is transferred to the pulse width modulator 205.

After repeatedly performing this process, the final remainder (1×8 bits) is inputted into the FIFO memory unit 2255. Hence, the FIEO memory unit 2255 outputs the remainder of the latch output 1202 for 4×255 lines earlier (1×8 bits), which output is transferred to the pulse width modulator 205 as 8 bits for the $256^{th}$ nozzle (Tp256).

Thus, each ink droplet ejected from each nozzle 300 is ejected while delayed so that the ink droplets ejected from all the nozzle 300 form a line in the X-direction. Accordingly, in the preferred embodiment, when the head module 103 is disposed at a slant in order to record at a desired resolution, the switching device 1200 can rearrange the switch pulse width data 202 in order to achieve the same effects obtained in the first embodiment described above.

While the invention has been described in detail with reference to specific embodiments thereof, it would be apparent to those skilled in the art that many modifications and variations may be made therein without departing from the spirit of the invention, the scope of which is defined by the attached claims.

Figure 15:
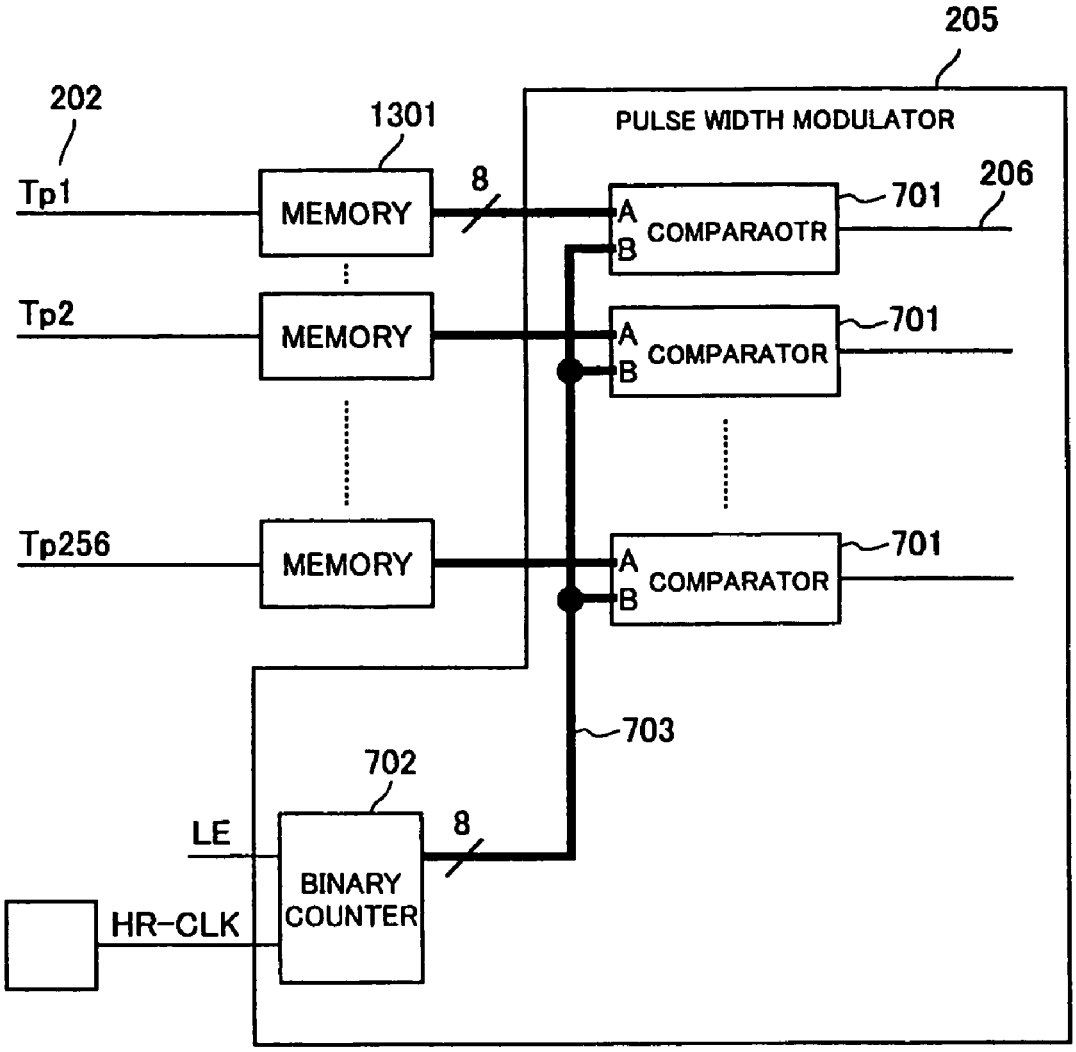
FIG. 15 is a block diagram showing a pulse width modulator according to a variation of the preferred embodiments.

For example, although the switch pulse width data 202 in the preferred embodiments described above is 8 bits in size, the switch pulse width data 202 may be set to any number of bits. When the switch pulse width data 202 is less than 8 bits, memory units 1301 may be disposed in direct connection to the inputs A of the magnitude comparators 701 to convert the switch pulse width data 20 from n bits to 8 bits, as shown in FIG. 15. Meanwhile, the switch pulse width data 202 is converted to a more detailed switch pulse width data 202.

Further, while only one head module 103 was described in the first and second embodiments, a plurality of head modules 103 may be provided. Though the switch pulse width data 202 is generated based 3×3 blocks (D11-D33) in the preferred embodiment, more blocks may be referred to generate the switch pulse width data 202.

What is claimed is:

1. An inkjet recording device comprising:

a nozzle module having a plurality of nozzles for ejecting ink droplets and a plurality of piezoelectric elements each including a common electrode and an individual electrode wherein the piezoelectric element is deformed when a potential difference is generated between the common electrode and the individual electrode, the nozzles being provided in one-to-one correspondence with the piezoelectric elements wherein each nozzle ejects the ink droplet in accordance with deformation of the corresponding piezoelectric element;

a switching unit including one terminal connected to the individual electrode and another terminal grounded, the switching unit arranged to open and close in response to a switch pulse, with an opening duration of the switch unit being variable depending on the switch pulse;

a waveform generating unit for applying a drive voltage to the common electrodes of all the nozzles commonly;

an image recognizing unit for receiving an ejection data indicating a type of each of a plurality of pixels of an image to be recorded, wherein the image recognizing unit is arranged for identifying blocks of said pixels and identifying an internal pixel from each of said blocks, and is arranged for generating a switch pulse width data corresponding to each of said blocks based on the ejection data of the internal pixel and the ejection data of other pixels of the block; and a pulse width modulating unit for generating the switch pulse based on the switch pulse width data, wherein the switch pulse width data indicates an ejection condition of ink droplets ejected from different ones of said nozzles.

2. The inkjet recording device according to claim 1, wherein the ejection condition includes weight and velocity.

3. The inkjet recording device according to claim 1, wherein the image recognizing unit is arranged to identify whether the internal pixel is a black pixel or a white pixel, and to identify whether at least one white pixel is included in pixels of the block encompassing the internal pixel, and to generate an image condition data based on said identifying whether the internal pixel is a black pixel or a white pixel, and to identify whether at least one white pixel is included in pixels of the block encompassing the internal pixel, and wherein the image recognizing unit generates the switch pulse width data based on the-image condition.

4. The inkjet recording device according to claim 3, wherein the image recognizing unit includes a storage unit storing a switch pulse width table for changing a flight condition of the ink droplet, and wherein the image recognizing unit is arranged to generate the switch pulse width data based on the image condition and the switch pulse width table.

5. The inkjet recording device according to claim 4, wherein the switch pulse width table includes a first switch pulse table for maintaining the weight of the ink droplet at a predetermined value and a second switch pulse table for maintaining the velocity of the ink droplet at a predetermined value, and wherein the image recognizing unit is arranged to refer to either of the first switch pulse width table or the second switch pulse width data based on the image condition.

6. The inkjet recording device according to claim 5, wherein the image recognizing unit refers to the first switch pulse width table when the type of pixel in question is the black pixel and all of the pixels encompassing the pixel in question are black pixels, and wherein the image recognizing unit is arranged to refer to the second switch pulse width table when the type of pixel in question is the black pixel and at least one white pixel is included in the pixels encompassing the pixel in question.

7. The inkjet recording device according to claim 3, wherein the image block includes 3-by-3 pixels.

8. An inkjet recording device according to claim 3, further comprising:

a conveying unit for conveying the recording medium relative to the nozzle module and for generating medium position detection signals each indicating a medium position, wherein the nozzles are arranged to eject the ink droplets in synchronous with the medium position detection signal in order to form one line worth of image;

a shift register for sequentially storing the switch pulse width data for each nozzle;

a latch for latching all of the switch pulse width data stored in the shift register in synchronous with the medium position detection signals at a time; and a pulse width modulating unit for opening or closing the switching unit based on the switch pulse width data latched by the latch.

9. The inkjet recording device according to claim 1, wherein the plurality of nozzles are slanted at a prescribed angle with respect to a first direction, the inkjet recording device further comprising:

a conveying unit conveying the recording medium relative to the nozzle module in a second direction orthogonal to the first direction and generating medium position detection signals each indicating a medium position, wherein the nozzles eject the ink droplets in synchronous with the medium position detection signal in order to form one line worth of image; and a switch pulse width data rearranging unit for rearranging the switch pulse width data so that the ink droplets are ejected along a line parallel to the first direction.

10. The inkjet recording device according to claim 9, wherein the switch pulse width data rearranging unit includes a plurality of FIFO memory units.

* * * * *